US012516394B2

(12) United States Patent
Kim et al.

(10) Patent No.: US 12,516,394 B2
(45) Date of Patent: Jan. 6, 2026

(54) PLATED STEEL SHEET FOR HOT PRESS FORMING HAVING EXCELLENT IMPACT PROPERTIES AFTER HOT PRESS FORMING, HOT PRESS FORMED MEMBER, AND MANUFACTURING METHODS THEREOF

(71) Applicant: POSCO, Pohang-si (KR)

(72) Inventors: Seong-Woo Kim, Gwangyang-si (KR); Jin-Keun Oh, Gwangyang-si (KR); Sang-Heon Kim, Gwangyang-si (KR); Yeol-Rae Cho, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 481 days.

(21) Appl. No.: 17/311,219

(22) PCT Filed: Dec. 19, 2019

(86) PCT No.: PCT/KR2019/018086
§ 371 (c)(1),
(2) Date: Jun. 4, 2021

(87) PCT Pub. No.: WO2020/130666
PCT Pub. Date: Jun. 25, 2020

(65) Prior Publication Data

US 2022/0025479 A1 Jan. 27, 2022

(30) Foreign Application Priority Data

Dec. 19, 2018 (KR) ..... 10-2018-0164822

(51) Int. Cl.
*C21D 1/00* (2006.01)
*B21D 22/02* (2006.01)
(Continued)

(52) U.S. Cl.
CPC ..... *C21D 9/46* (2013.01); *B21D 22/022* (2013.01); *C21D 8/0226* (2013.01);
(Continued)

(58) Field of Classification Search
None
See application file for complete search history.

(56) References Cited

U.S. PATENT DOCUMENTS 6,296,805 B1 10/2001 Laurent et al.
2010/0104891 A1 4/2010 Nakagaito et al.
(Continued)

FOREIGN PATENT DOCUMENTS

CN 102369305 A 3/2012
CN 102652177 A 8/2012
(Continued)

OTHER PUBLICATIONS

Merriam-Webster Dictionary, "Galvanized", 2016, accessed online Apr. 14, 2023 using web.archive.org at merriam-webster.com/dictionary/galvanized (Year: 2016).*
(Continued)

*Primary Examiner* — Kim S. Horger
(74) *Attorney, Agent, or Firm* — Morgan Lewis & Bockius LLP (WA)

(57) ABSTRACT

The present disclose relates to a plated steel sheet for hot press forming having excellent impact properties after hot press forming. The plated steel sheet includes: a base steel sheet containing, by weight, 0.15-0.4% of C, 0.1-1% of Si, 0.6-8% of Mn, 0.001-0.05% of P, 0.0001-0.02% of S, 0.01-0.1% of Al, 0.001-0.02% of N, 0.01-0.5% of Cr, and impurities; and a plating layer formed on the surface of the base steel sheet and composed of zinc, aluminum, or an alloy containing zinc and aluminum. The ratio (CS/CB) of a C content (CS) in a surface layer to a C content (CB) in the
(Continued)

base steel sheet is 0.6 or less. The ratio ((MnS+CrS)/(MnB+CrB)) of the total content (MnS+CrS) of Mn and Cr in the surface layer to the total content (MnB+CrB) of Mn and Cr in the base steel sheet is 0.8 or more.

3 Claims, 2 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |
| ***C23C 2/02*** | (2006.01) |
| ***C25D 3/22*** | (2006.01) |
| ***C25D 3/44*** | (2006.01) |

(52) U.S. Cl.

CPC ..... *C21D 8/0236* (2013.01); *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/32* (2013.01); *C23C 2/02* (2013.01); *C23C 2/022* (2022.08); *C23C 2/0224* (2022.08); *C25D 3/22* (2013.01); *C25D 3/44* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2012/0018060 | A1 | 1/2012 | Fushiwaki et al. |
| 2013/0180305 | A1 | 7/2013 | Warnecke et al. |
| 2013/0327452 | A1 | 12/2013 | Fushiwaki et al. |
| 2016/0017452 | A1 | 1/2016 | Puerta Velsquez et al. |
| 2016/0340755 | A1* | 11/2016 | Han ..... C23C 2/02 |
| 2016/0362763 | A1 | 12/2016 | Oh et al. |
| 2016/0376679 | A1 | 12/2016 | Kim et al. |
| 2017/0029915 | A1 | 2/2017 | Hayashi |
| 2017/0037488 | A1 | 2/2017 | Hasegawa et al. |
| 2018/0105908 | A1 | 4/2018 | Hayashi et al. |
| 2018/0371570 | A1 | 12/2018 | Kim et al. |
| 2019/0003029 | A1 | 1/2019 | Oh et al. |
| 2019/0271355 | A1 | 9/2019 | Takata et al. |
| 2019/0368015 | A1 | 12/2019 | Koo et al. |
| 2020/0087747 | A1 | 3/2020 | Kim et al. |
| 2022/0025479 | A1 | 1/2022 | Kim et al. |

FOREIGN PATENT DOCUMENTS

| | | | |
|---|---|---|---|
| CN | 104769138 | A | 7/2015 |
| CN | 105829563 | A | 8/2016 |
| CN | 106103771 | A | 11/2016 |
| CN | 106164318 | A | 11/2016 |
| CN | 107532266 | A | 1/2018 |
| CN | 108431273 | A | 8/2018 |
| CN | 108474096 | A | 8/2018 |
| EP | 3287539 | A1 | 2/2018 |
| EP | 3751016 | A1 | 12/2020 |
| JP | 2006-037130 | A | 2/2006 |
| JP | 2006-265583 | A | 10/2006 |
| JP | 2022-513264 | A | 2/2022 |
| KR | 10-2009-0115873 | A | 11/2009 |
| KR | 10-2010-0047011 | A | 5/2010 |
| KR | 10-1482345 | B1 | 1/2015 |
| KR | 10-2015-0047627 | A | 5/2015 |
| KR | 10-1569505 | B1 | 11/2015 |
| KR | 10-1758485 | B1 | 7/2017 |
| KR | 10-1858868 | B1 | 5/2018 |
| KR | 10-2018-0070940 | A | 6/2018 |
| WO | 2011/069906 | A2 | 6/2011 |
| WO | 2014/037627 | A1 | 3/2014 |
| WO | 2014/166630 | A1 | 10/2014 |
| WO | 2015/097882 | A1 | 7/2015 |
| WO | 2016/171237 | A1 | 10/2016 |
| WO | 2018/079839 | A1 | 5/2018 |
| WO | 2018/117501 | A1 | 6/2018 |
| WO | 2018/117543 | A1 | 6/2018 |
| WO | 2018/220430 | A1 | 12/2018 |

OTHER PUBLICATIONS

Susanto et al., "Selective Oxidation and Sub-surface Phase Transformations in Chromium-bearing Austenitic Steels", Jun. 2005, Oxidation of Metals, vol. 63, p. 277-304 (Year: 2005).*

Chinese Office Action dated Apr. 29, 2022 issued in Chinese Patent Application No. 201980084549.4.

International Search Report dated Apr. 1, 2020 issued in International Patent Application No. PCT/KR2019/018086 (with English translation).

Extended European Search Report dated Oct. 18, 2021 issued in European Patent Application No. 19901117.2.

Key to Metals AG, "Residual Elements in Steel," Internet Citation, Jul. 1, 2007.

M. Naderi et al., "An investigation into martensitic transformation in hot stamping process," Computational Methods and Experiments in Materials Characterisation III, WIT Transactions on Engineering Sciences, vol. 57, May 24, 2007, pp. 95-104.

Japanese Office Action dated Sep. 27, 2022 issued in Japanese Patent Application No. 2021-534691.

Notice of Acceptance of 2nd Invalidation Trial Request by ArcelorMittal cited in Chinese Patent Application No. 201980084549.4 dated Nov. 13, 2024 (with partial English translation).

Notice of Acceptance of Invalidation Trial Request by Nextev(with additional information starting from p. 19) cited in Chinese Patent Application No. 201980084549.4 dated Nov. 11, 2024 (with partial English translation).

Chinese Opposition Notice dated Feb. 11, 2025 issued in Chinese Patent Application No. 201980084549.4 (with English translation).

Chinese Office Action dated Feb. 24, 2025 issued in Chinese Patent Application No. 202310549754.1 (with English translation).

Evidence 12, Japan Shimonoseki Notary Office 2025, No. 12 Notarized certificate (Machine translation).

Evidence 13, Japan local Notary Office 2024, No. 783 Notarized certificate (Machine translation).

Evidence 14, Japan Kojimachi Notary Public 2025, No. 12 Notarized certificate (Machine translation).

Evidence 15, Japan Onoue Town Notary Public 2025, No. 37 Notarized certificate (Machine translation).

Evidence 16, Beijing Municipal Notary Office (2024), Notary Public No. 36115 Notarized Document (Machine translation).

Evidence 17, Beijing Municipal Notary Office (2024), Notary Public No. 45470 Notarized Document (Machine translation).

Evidence 18, Beijing GuoChuangDingCheng Intellectual Property Application Technology Research Institute Appraisal Opinion, GuoChuang Appraisal [2024], No. 778-7 (Machine translation).

Evidence 19, Beijing GuoChuangDingCheng Intellectual Property Application Technology Research Institute Appraisal Opinion, GuoChuang Appraisal [2024], No. 778-8 (Machine translation).

Evidence 20, Beijing GuoChuangDingCheng Intellectual Property Application Technology Research Institute Appraisal Opinion, GuoChuang Appraisal [2024], No. 778-9 (Machine translation).

Evidence 21, TSA-05-20241203869342313 <Trusted Timestamp Certification Certificate> (Timestamp video content capture <golf-7-technical-preview>, released on Sep. 6, 2012, public enthusiast forum, site: https://www.vwvortex.com/threads/golf-7-technical-preview.9448465/).

(56) References Cited

OTHER PUBLICATIONS

Evidence 22, Notarized document No. 2751 by the Beijing Municipal Government (2025) (Machine tranlsation).
Evidence 23, "Hot Stamping of Ultra High-Strength Steels , From a Technological and Business Perspective" and Chinese translation, edited by Eren Billur, Springer Nature Switzerland AG, published 2019.
Evidence 24, "Leichtbau in der Fahrzeugtechnik" Horst E. Friedrich, Springer, Release date 2013 (Machine translation).
European Communication dated May 23, 2024 issued in European Patent Application No. 19901117.2 (Third Party Observation).
Japanese Office Action dated Jul. 30, 2024 issued in Japanese Patent Application No. 2023-078716.
European Office Action dated Nov. 12, 2025 issued in European Patent Application No. 19901117.2.
Panasiuk et al., "International Comparison of Impurities Mixing and Accumulation in Steel Scrap," (2022) XP93219965.

* cited by examiner

[FIG. 1]
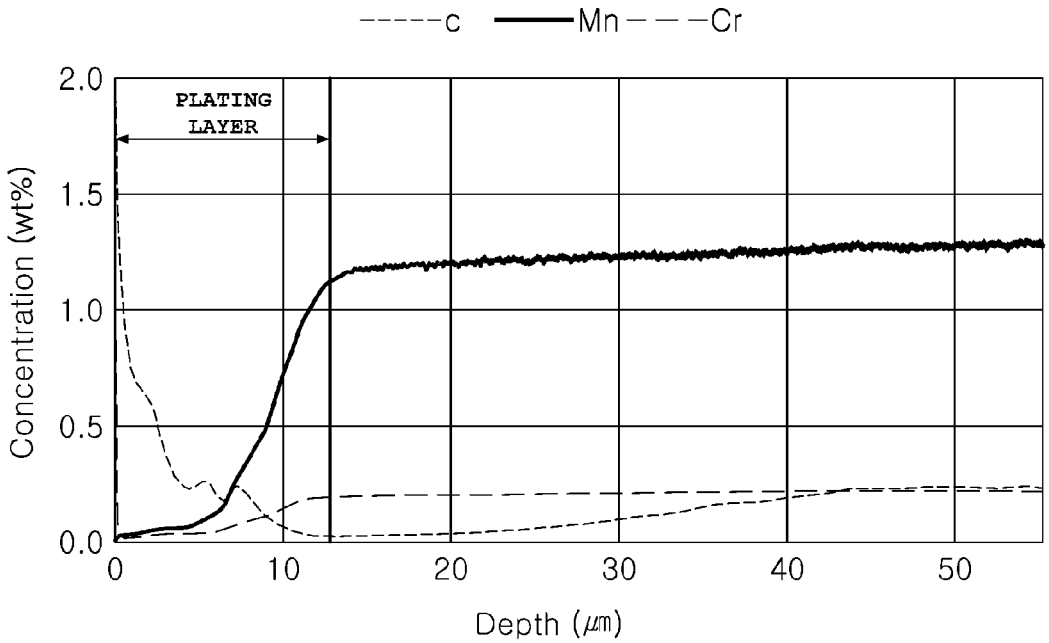
[FIG. 2]
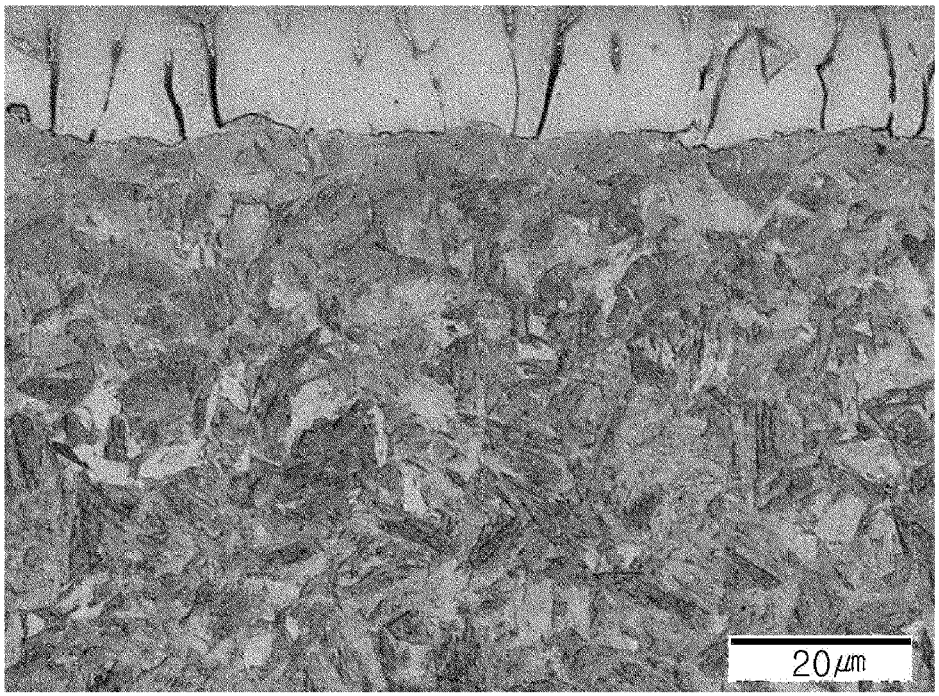

PLATED STEEL SHEET FOR HOT PRESS FORMING HAVING EXCELLENT IMPACT PROPERTIES AFTER HOT PRESS FORMING, HOT PRESS FORMED MEMBER, AND MANUFACTURING METHODS THEREOF

CROSS-REFERENCE OF RELATED APPLICATIONS

This application is the U.S. National Phase under 35 U.S.C. § 371 of International Patent Application No. PCT/KR2019/018086, filed on Dec. 19, 2019, which in turn claims the benefit of Korean Application No. 10-2018-0164822, filed on Dec. 19, 2018, the entire disclosures of which applications are incorporated by reference herein.

TECHNICAL FIELD

The present disclosure relates to a plated steel sheet for hot press forming having excellent impact resistant properties after hot press forming, which may preferably be applied to automobile parts that require impact resistance, a hot press formed member, and manufacturing methods thereof.

BACKGROUND ART

In recent years, due to depletion of petroleum energy resources and high interest in the environment, regulations on improving fuel efficiency of automobiles have been strengthened. In terms of materials, reducing a thickness of a steel sheet used in automobiles may be a method for improving fuel efficiency of automobiles. However, reducing the thickness of a steel sheet may cause problems in automobile safety, and thus, in this case, improvement of strength of the steel sheet should be facilitated.

Thus, there has been continuous demand for high-strength steel sheets, and various kinds of steel sheets have been developed. However, since these steel sheets have high strength in themselves, workability thereof is poor. That is, since a product of strength and elongation for each grade of steel sheet tends to always have a constant value, when strength of the steel sheet increases, there may be a problem that elongation, an index of workability, decreases.

In order to solve this problem, a hot press forming method has been proposed. The hot press forming method is a method forming a low temperature structure, such as martensite, in a steel sheet by forming at a high temperature suitable for forming and then quenching the steel sheet at a low temperature strength of a final product. In this case, there is advantage that the problem of workability may be minimized when manufacturing a member having high strength.

A typical technology regarding such a hot press formed member includes Patent document 1. In Patent document 1, an Al—Si plated steel sheet is heated to 850° C. or higher, hot-rolled formed by press and subsequently quenched to form a structure of a member into martensite, thereby securing ultra-high tensile strength exceeding 1600 MPa. Securing such ultra-high tensile strength facilitates achieving of lightweight vehicles. However, according to Patent document 1, impact resistant properties are relatively inferior in case of a collision due to high strength, and a phenomenon in which abnormally low impact resistant properties appear in some cases depending on hot press forming conditions, etc., occurs.

Accordingly, Patent document 2 proposes a technique of improving impact resistant properties after hot press forming by spheroidizing inclusions by adjusting a ratio of Ca/S and refining grains by adding an alloy element such as niobium (Nb) to a steel for hot press forming. However, Patent document 2 relates to inclusions control and grain size control to improve impact resistant properties of general steel materials and is evaluated to have a difficulty in being applied as a means for improving low impact resistant properties that occur during actual hot press forming in the hot press forming field.

Therefore, there is a need for development of a plated steel sheet for hot press forming having excellent impact resistant properties after hot press forming, a hot press formed member, and manufacturing methods thereof.

(Patent document 1) US Patent Publication No. 6296805

(Patent document 2) Korean Publication No. 10-2010-0047011

DISCLOSURE

Technical Problem

An aspect of the present disclosure may provide a plated steel sheet for hot press forming having excellent impact resistant properties after hot press forming, a hot press formed member, and manufacturing methods thereof.

The technical problem of the present disclosure is not limited to the aforementioned matters. Additional problems of the present disclosure are described in the overall contents of the disclosure, and those of ordinary skill in the art to which the present disclosure pertains will not have any difficulty in understanding the additional problems of the present disclosure from the contents described in the disclosure of the present disclosure.

Technical Solution

According to an aspect of the present disclosure, a plated steel sheet for hot press forming having excellent impact resistant properties after hot press forming includes: a base steel sheet including, by wt %, 0.15% to 0.4% of carbon (C), 0.1% to 1% of silicon (Si), 0.6% to 8% of manganese (Mn), 0.001% to 0.05% of phosphorus (P), 0.0001% to 0.02% of sulfur (S), 0.01% to 0.1% of aluminum (Al), 0.001% to 0.02% of nitrogen (N), 0.01% to 0.5% of chromium (Cr), a balance of Fe, and other impurities; and a plating layer formed of zinc, aluminum, or alloys thereof on a surface of the base steel sheet, wherein a ratio ($C_s/C_B$) of a C content ($C_S$) of a surface layer portion to a C content ($C_B$) of the base steel sheet is 0.6 or less, and a ratio ($(Mn_S+Cr_S)/(Mn_B+Cr_B)$) of the sum ($Mn_S+Cr_S$) of contents of Mn and Cr of the surface layer portion to the sum ($Mn_B+Cr_B$) of contents of Mn and Cr of the base steel sheet is 0.8 or more, wherein the surface layer portion refers to a region to a depth of 15 μm from the surface of the base steel sheet excluding the plating layer.

The base steel sheet may further include, by wt %, one or more of 0.0005% to 0.01% of boron (B) and 0.01% to 0.05% of titanium (Ti).

A microstructure of the base steel sheet may include, by area fraction, 40% to 100% of ferrite and a balance of 0% to 60% of pearlite, bainite, or martensite in the surface layer portion and may include 30% to 90% of ferrite and a balance of 10% to 70% of pearlite, bainite, or martensite in a central portion thereof.

According to another aspect of the present disclosure, a hot press formed member having excellent impact resistant properties includes: a base steel sheet including, by wt %, 0.15% to 0.4% of carbon (C), 0.1% to 1% of silicon (Si), 0.6% to 8% of manganese (Mn), 0.001% to 0.05% of phosphorus (P), 0.0001% to 0.02% of sulfur (S), 0.01% to 0.1% of aluminum (Al), 0.001% to 0.02% of nitrogen (N), 0.01% to 0.5% of chromium (Cr), a balance of Fe, and other impurities; and an alloy plating layer formed of an alloy including zinc or aluminum on a surface of the base steel sheet, wherein a ratio ($C_{PS}/C_B$) of a C content ($C_{PS}$) of a member surface layer portion to a C content ($C_B$) of the base steel sheet is 1.2 or less, and a ratio ($(Mn_{PS}+Cr_{PS})/(Mn_B+Cr_B)$) of the sum ($Mn_{PS}+Cr_{PS}$) of contents of Mn and Cr of the member surface layer portion to the sum ($Mn_B+Cr_B$) of contents of Mn and Cr of the base steel sheet is 0.8 or more, wherein the member surface layer portion refers to a region to a depth of 25 μm from the surface of the base steel sheet excluding the alloy plating layer.

A coverage rate of ferrite at a martensitic grain boundary of the member surface layer portion may be 30% or less.

According to another aspect of the present disclosure, a method of manufacturing a plated steel sheet for hot press forming having excellent impact resistant properties after hot press forming includes: preparing a slab including, by wt %, 0.15% to 0.4% of carbon (C), 0.1% to 1% of silicon (Si), 0.6% to 8% of manganese (Mn), 0.001% to 0.05% of phosphorus (P), 0.0001% to 0.02% of sulfur (S), 0.01% to 0.1% of aluminum (Al), 0.001% to 0.02% of nitrogen (N), 0.01% to 0.5% of chromium (Cr), a balance of Fe, and other impurities and heating the slab at a temperature of 1050° C. to 1300° C.; hot rolling the heated slab in a finish hot rolling temperature range of 800° C. to 950° C. to obtain a hot rolled steel sheet; coiling the hot rolled steel sheet at 450° C. to 750° C. after the finish hot rolling terminates; annealing the coiled hot rolled steel sheet by heating at 740° C. to 860° C. under the atmosphere in which a dew point temperature is −10° C. to 30° C. for 10 to 600 seconds; and immersing the hot rolled steel sheet after annealing in a plating bath formed of zinc, aluminum, or alloys thereof to perform plating.

The method may further include: cold rolling the hot rolled steel sheet before being coiled after the hot rolling, to obtain cold rolled steel sheet.

The slab may further include, by wt %, one or more of 0.00005% to 0.01% of boron (B) and 0.01% to 0.05% of titanium (Ti).

According to another aspect of the present disclosure, a method of manufacturing a hot press formed member having excellent impact resistant properties, includes: heat-treating the plated steel sheet for hot press forming manufactured by the method of manufacturing a plated steel sheet for hot press forming having excellent impact resistant properties after hot press forming described above in a temperature range of Ac3 to 950° C. for 1 to 15 minutes; and subsequently performing hot press forming.

Advantageous Effects

According to the present disclosure, a plated steel sheet for hot press forming having excellent impact resistant properties after hot press forming, and a manufacturing method thereof may be provided.

The hot press formed member manufactured by hot press forming a plated steel sheet for hot press forming according to the present disclosure has a bending angle of 60° or more as measured by a VDA238-100 bending test at a tensile strength of 1500 MPa, thereby ensuring excellent impact properties.

Various and beneficial advantages and effects of the present disclosure are not limited to the above description and will be more easily understood in the course of describing specific embodiments of the present disclosure.

DESCRIPTION OF DRAWINGS

FIG. 1 is a result of an analysis of concentration of carbon (C), manganese (Mn), and chromium (Cr) in a depth direction from a surface layer portion using a GDS before hot press forming for the plated steel sheet for hot press forming of Inventive Example 1.

FIG. 2 is an optical microscope photograph showing a structure of a member surface layer portion after hot press forming of Inventive Example 1.

BEST MODE FOR INVENTION

Figure 3:
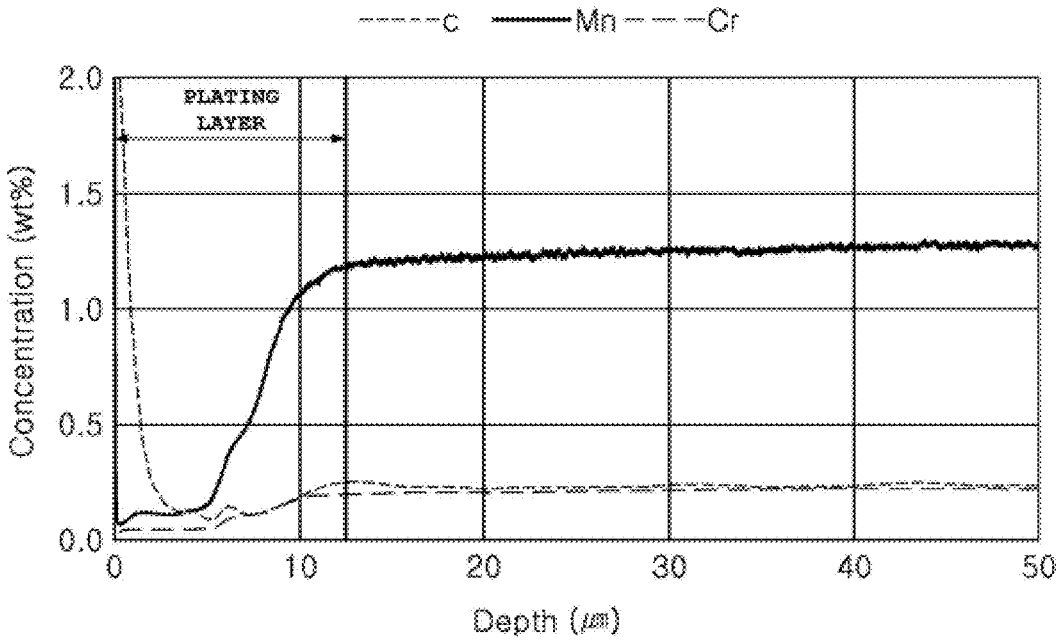
FIG. 3 is a result of an analysis of concentration of carbon (C), manganese (Mn), and chromium (Cr) in a depth direction from a surface layer portion using a GDS before hot press forming for the plated steel sheet for hot press forming of Comparative Example 1.
Figure 4:
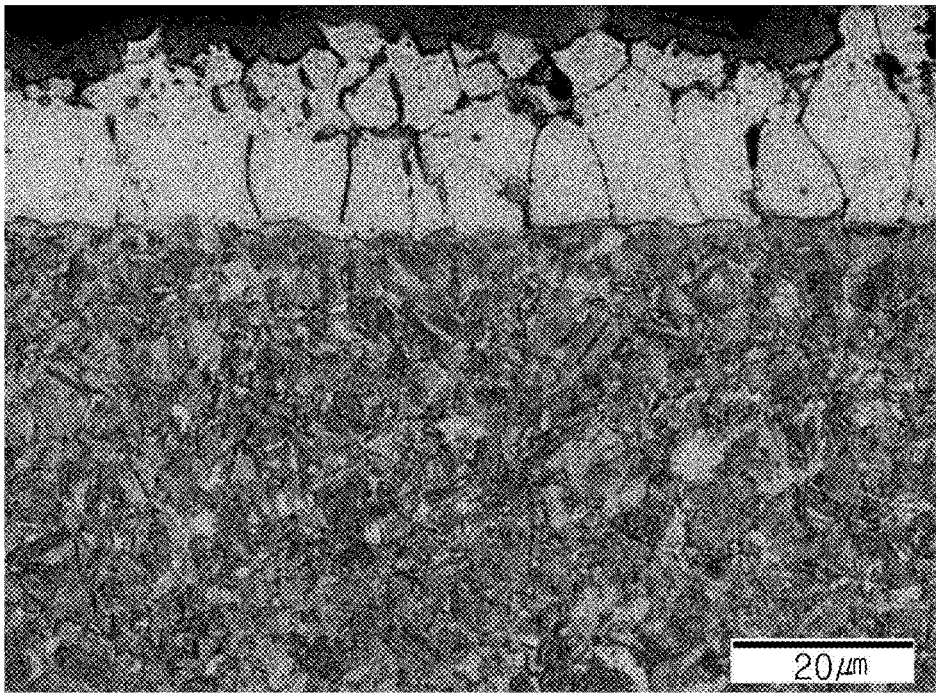
FIG. 4 is an optical microscope photograph showing the structure of the member surface layer portion after hot press forming of Comparative Example 3.

Hereinafter, embodiments of the present disclosure will be described. However, embodiments of the present disclosure may be modified in various other forms, and the scope of the present disclosure is not limited to the embodiments described below. In addition, embodiments of the present disclosure are provided in order to more completely explain the present disclosure to those with average knowledge in the art.

The inventors of the present application noted that a bending angle of a non-plated material after hot press forming is significantly superior to that of a plated material. As a result of further research thereon, it was confirmed that, in the case of non-plated materials, decarburization occurred in a surface layer portion of a steel sheet during heating for hot press forming, and as a result, a soft ferrite layer was formed on the surface layer portion, resulting in excellent bendability.

With this, the present inventors focused on the idea that bendability of a hot press formed member may be improved if it is possible to form a soft layer on the surface layer portion of the base steel sheet by lowering a C content of the surface layer portion in plated materials. However, it was found that, in the case of plated materials, it is difficult to form a soft ferrite layer as in the non-plated materials because decarburization does not occur sufficiently during heating for hot press forming like non-plated materials, and if the ferrite layer is not sufficiently formed continuously, bendability is rather degraded.

The present inventors studied further in depth to overcome the problem, and resultantly completed the present disclosure upon confirming that a plated steel sheet for hot press forming having excellent impact resistant properties after hot press forming, a hot press formed member, and manufacturing methods thereof can be provided by controlling a C content at a surface layer portion of the base steel sheet to below a predetermined level compared to a C content at a central portion of the base steel sheet and controlling the sum of contents of Mn and Cr at the surface layer portion of the base steel sheet to above a predetermined level compared to the sum of contents of Mn and Cr at the central portion through control of annealing conditions.

Hereinafter, first, a plated steel sheet for hot press forming and a hot press formed member having excellent impact resistant properties after hot press forming according to an aspect of the present disclosure will be described in detail.

Plated steel sheet for hot press forming having excellent impact resistant properties after hot press forming A plated steel sheet for hot press forming having excellent impact resistant properties after hot press forming according to an aspect of the present disclosure includes: a base steel sheet including, by wt %, 0.15% to 0.4% of carbon (C), 0.1% to 1% of silicon (Si), 0.6% to 8% of manganese (Mn), 0.001% to 0.05% of phosphorus (P), 0.0001% to 0.02% of sulfur (S), 0.01% to 0.1% of aluminum (Al), 0.001% to 0.02% of nitrogen (N), 0.01% to 0.5% of chromium (Cr), a balance of Fe, and other impurities; and a plating layer formed of zinc, aluminum, or alloys thereof on a surface of the base steel sheet, wherein a ratio ($C_S/C_B$) of a C content ($C_S$) of a surface layer portion to a C content ($C_B$) of the base steel sheet is 0.6 or less, and a ratio ($(Mn_S+Cr_S)/(Mn_B+Cr_B)$) of the sum ($Mn_S+Cr_S$) of contents of Mn and Cr of the surface layer portion to the sum ($Mn_B+Cr_B$) of contents of Mn and Cr of the base steel sheet is 0.8 or more.

First, an alloy composition of a base steel sheet of the present disclosure will be described in detail. In the present disclosure, it should be appreciated that the content of each element refers to percent by weight (wt %), unless otherwise specified.

C: 0.15% to 0.4%

C is an essential element to increase strength of a hot press formed member. If a C content is less than 0.15%, it may be difficult to secure sufficient strength. Meanwhile, if the C content is more than 0.4%, strength of A hot-rolled material is too high when the hot-rolled material is cold-rolled, so that cold-rolling properties may be significantly inferior and spot weldability may be significantly reduced. Therefore, in the present disclosure, the C content may be limited to 0.15 to 0.4%.

Si: 0.1% to 1%

Si, added as a deoxidizer in steel making, is an element for solid solution strengthening, an element for inhibiting an occurrence of a carbide. In addition, Si contributes to an increase in strength of the hot press formed member, and an element effective in material uniformity. If an Si content is less than 0.1%, the aforementioned effect is insufficient. Meanwhile, if the Si content exceeds 1%, Al plating properties may be significantly deteriorated by an Si oxide generated on a surface of the steel sheet during annealing. Therefore, in the present disclosure, the Si content may be limited to 0.1% to 1%.

Mn: 0.6% to 8%

Mn is an element added to ensure a solid solution strengthening effect and to lower a critical cooling rate for securing martensite in the hot press formed member. In order to obtain the above effect, it is necessary for Mn to be added in an amount of 0.6% or more. Meanwhile, if the Mn content is more than 8%, cold rolling properties may be lowered due to an increase in strength of the steel sheet before the hot press forming, a cost for ferroalloy may be increased, and spot weldability is inferior. Therefore, in the present disclosure, the Mn content may be limited to 0.6% to 8%.

P: 0.001% to 0.05%

Phosphorus (P) is present as an impurity in the steel and a less content thereof is advantageous. Accordingly, in the present disclosure, the P content may be limited to 0.05% or less, and preferably, may be limited to 0.03% or less. Since a smaller amount of P is advantageous, there is no need to specifically set a lower limit of the content. However, excessive lowering the P content may lead to an increase in manufacturing cost, and in consideration of this, the lower limit of the P content may be set to 0.001%.

S: 0.0001% to 0.02%

Sulfur (S) is an impurity in the steel and is an element that inhibits ductility, impact characteristics and weldability of the member. Thus, a maximum content of S is limited to 0.02%, and preferably, to 0.01% or less. In addition, if a minimum content thereof is less than 0.0001%, manufacturing cost may increase, so a lower limit of the S content may be set to 0.0001%.

Al: 0.01% to 0.1%

Al may increase cleanliness of the steel by deoxidizing the steel together with Si. And, Al may be added in an amount of 0.01% or more to obtain the above effect. However, if it exceeds 0.1%, high temperature ductility due to excessive AlN formed during a casting process may be deteriorated to cause cracks in slab, so an upper limit of the content may be set to 0.1% or less. Therefore, in the present disclosure, the Al content is preferably 0.01% to 0.1%.

N: 0.001% to 0.02%

N is an element included as an impurity in steel. If a N content is more than 0.02%, high temperature ductility may be deteriorated due to excessive AlN formed during the casting process to result in slab cracking. Therefore, to reduce sensitivity to cracking during continuous slab casting and to secure impact properties, N may be included in an amount of 0.02% or less. A lower limit may not be specifically set, but, in consideration of an increase in manufacturing cost, the lower limit of the N content may be set to 0.001% or more. Therefore, in the present disclosure, the N content is preferably 0.001% to 0.02%.

Cr: 0.01% to 0.5%

Cr is an element added to improve the effect of solid solution strengthening and hardenability during hot press forming, similar to Mn, and may be added in an amount of 0.01% or more to obtain the above effect. However, if the Mn content exceeds 0.5%, hardenability may be sufficiently secured, but the properties may be saturated and cost of manufacturing the steel sheet may increase. Therefore, in the present disclosure, the Cr content is preferably 0.01% to 0.5%.

The base steel sheet of the plated steel sheet for hot press forming according to an aspect of the present disclosure may further include one or more of 0.0005% to 0.01% of boron (B) and 0.01% to 0.05% of titanium (Ti) in addition to the aforementioned components.

B: 0.0005% to 0.01%

B is an element which improves hardenability even with a small amount of addition and segregates along prior-austenite grain boundaries to suppress embrittlement of the hot press formed member due to grain boundary segregation of P and/or S, and may be added in an amount of 0.0005% or more to obtain the above effect. However, if a B content exceeds 0.01%, the effect is saturated and brittleness is caused in hot rolling, so an upper limit of the B content may be set to 0.01%, and preferably, the B content may be set to 0.005% or less. Therefore, in the present disclosure, the B content is preferably 0.0005% to 0.01%.

Ti: 0.01% to 0.05%

Ti is added to be combined with nitrogen remaining as an impurity in the steel to produce TiN, thereby causing solid solution B, essential for securing hardenability, to remain. If a Ti content is less than 0.01%, it may be difficult to sufficiently obtain the above effect, and if the Ti content is more than 0.05%, the properties may be saturated and cost for manufacturing the steel sheet may increase. Therefore, in the present disclosure, the Ti content is preferably 0.01% to 0.05%.

The balance other than the aforementioned components is iron (Fe), and addition of a component is not limited as long as the component may be included in the steel sheet for hot press forming. In addition, unintended impurities coming from raw materials or a surrounding environment may inevitably be mixed in a general manufacturing process, which cannot be excluded. Since these impurities are known to a person skilled in the manufacturing process, all the contents are not specifically mentioned in the present disclosure.

The plated steel sheet for hot press forming having excellent impact resistant properties after the hot press forming according to an aspect of the present disclosure, includes a plating layer formed(consisted) of zinc, aluminum, or alloys thereof formed on a surface of the base steel sheet. The plating layer imparts corrosion resistance of the member in a final part and serves to inhibit decarburization and scale formation of the base steel sheet during heating for hot press forming.

In the present disclosure, a type of the plating layer is not particularly limited, and any plating layer applied to a steel sheet for hot press forming of the related art may be applied to the present disclosure without limitation. As a non-limiting embodiment, the plating layer may be formed of zinc, aluminum, or alloys thereof, and more specifically, the plating layer may be a hot-dip galvanizing layer, an electro-galvanizing layer, an alloying zinc plating layer, an aluminum plating layer, or an aluminum alloy plating layer.

Meanwhile, according to an aspect of the present disclosure, the plating layer may include components that may be included during the manufacturing process within a range that does not impair the object of the present disclosure and may include other inevitable impurities in particular.

In addition, a thickness of the plating layer may be 5 μm to 100 μm. If the thickness of the plating layer is less than 5 μm, it may be difficult to exhibit sufficient corrosion resistance in the hot press formed member, and if the thickness is more than 100 μm, a heating time for hot press forming may excessively increase and manufacturing cost for the effect of improving corrosion resistance may excessively increase.

Meanwhile, in the plated steel sheet for hot press forming according to the present disclosure, a ratio ($C_S/C_B$) of a C content ($C_S$) of a surface layer portion to a C content ($C_B$) of the base steel sheet (hereinafter, referred to as "ratio ($C_S/C_B$)") is 0.6 or less. Here, the surface layer portion refers to a region from a surface of the base steel sheet excluding the plating layer to a depth of 15 μm.

In addition, according to an aspect of the present disclosure, in the plated steel sheet for hot press forming, the ratio ($C_S/C_B$) of the C content ($C_S$) of the surface layer portion to the C content ($C_B$) of the base steel sheet may preferably be 0.5 or less, more preferably 0.4 or less, and most preferably 0.35 or less.

When the ratio ($C_s/C_B$) is controlled to be less than 0.6, a relatively soft martensite phase may be formed in the surface layer portion with a low C content, unlike a hard martensite phase formed in the center of the base steel sheet after hot press forming. As the soft martensite phase is formed on the surface layer portion of the plated steel sheet, hardness of the surface layer portion decreases, thereby securing excellent bending characteristics. If the ratio ($C_s/C_B$) exceeds 0.6, it may be difficult to realize the effect of improving the bendability through softening of the surface layer portion after hot press forming. A lower limit of the ratio ($C_s/C_B$) may not be limited particularly. However, if the C content in the surface layer portion is too low, strength of the member may decrease or fatigue properties may be inferior after hot press forming, so the lower limit of the ratio ($C_s/C_B$) may be set to 0.05 or more, but is not limited thereto.

In addition, in the plated steel sheet for hot press forming according to an aspect of the present disclosure, a ratio ($(Mn_S+Cr_S)/(Mn_B+Cr_B)$) of the sum ($Mn_s+Cr_S$) of contents of Mn and Cr of the surface layer portion to the sum ($Mn_B+Cr_B$) of contents of Mn and Cr of the base steel sheet (hereinafter, refer to as "(ratio ($Mn_S+Cr_S)/(Mn_B+Cr_B$))") may be 0.8 or more. Here, the surface layer portion refers to a region from the surface of the base steel sheet excluding the plating layer to a depth of 15 μm.

Meanwhile, according to an aspect of the present disclosure, in the plated steel sheet for hot press forming, the ratio ($(Mn_S+Cr_S)/(Mn_B+Cr_B)$) of the sum ($Mn_S+Cr_S$) of the contents of Mn and Cr of the surface layer portion to the sum ($Mn_B+Cr_B$) of the contents of Mn and Cr of the base steel sheet may preferably be 0.85 or more, and more preferably 0.87 or more.

If the ratio ($(Mn_S+Cr_S)/(Mn_B+Cr_B)$) is less than 0.8, hardenability of the surface layer portion may be insufficient during hot press forming, so that ferrite may be partially formed on a surface of the member. Since ferrite partially formed at the hard martensitic grain boundary is a factor that significantly deteriorates bendability, the ratio ($(Mn_S+Cr_S)/(Mn_B+Cr_B)$) is preferably 0.8 or more. An upper limit of the ratio ($(Mn_S+Cr_S)/(Mn_B+Cr_B)$) does not need to be limited, but if the contents of Mn and Cr in the surface layer portion are too high, hardness of the surface layer portion after hot press forming may increase to rather deteriorate bendability. Therefore, the upper limit of the ratio ($(Mn_S+Cr_S)/(Mn_B+Cr_B)$) may be 2 or less, but is not limited thereto.

Meanwhile, a microstructure of the base steel sheet does not need to be particularly limited. However, the microstructure of the surface layer portion in the base steel sheet may include, by area fraction, 40% to 100% of ferrite and a balance of 0% to 60% of pearlite, bainite or martensite. In addition, the microstructure of a central portion in the base steel may include, by area fraction, 30% to 90% of ferrite and a balance of 10% to 70% of pearlite, bainite or martensite.

Hot press formed member having excellent impact properties.

Meanwhile, a hot press formed member having excellent impact resistant properties may be manufactured by heat-treating the plated steel sheet for hot press forming having the aforementioned configuration in a temperature range of Ac3 to 950° C. for 1 to 15 minutes and subsequently performing hot press forming thereon.

A hot press formed member having excellent impact resistant properties according to an aspect of the present disclosure includes a base steel sheet having the same alloy composition as that of the base steel sheet of the plated steel sheet and an alloy plating layer formed of an alloy including zinc or aluminum on a surface of the base steel sheet, wherein a ratio ($C_{PS}/C_B$) of a C content ($C_p$s) of a member surface layer portion to a C content ($C_B$) of the base steel sheet is 1.2 or less, and a ratio ($(Mn_{PS}+Cr_{PS})/(Mn_B+Cr_B)$) of the sum ($Mn_{PS}+Cr_{PS}$) of contents of Mn and Cr of the member surface layer portion to the sum ($Mn_B+Cr_B$) of contents of Mn and Cr of the base steel sheet (hereinafter, referred to as "ratio ($(Mn_{PS}+Cr_{PS})/(Mn_B+Cr_B)$)) is 0.8 or more. Here, the member surface layer portion refers to a region from the surface of the base steel sheet excluding the alloy plating layer to a depth of 25 μm.

Meanwhile, according to an aspect of the present disclosure, in the hot press formed member, the ratio ($C_{PS}/C_B$) of the C content ($C_{PS}$) of the member surface layer portion to the C content ($C_B$) of the base steel sheet may preferably be 1.1 or less, and more preferably 1.05 or less.

In addition, according to an aspect of the present disclosure, in the hot press formed member, the ratio (($Mn_{PS}$+$Cr_{PS}$)/($Mn_B$+$Cr_B$)) of the sum ($Mn_{PS}$+$Cr_{PS}$) of the contents of Mn and Cr of the member surface layer portion to the sum ($Mn_B$+$Cr_B$) of the contents of Mn and Cr of the base steel sheet may preferably be 0.9 or more, and more preferably 0.93 or more.

Generally, when the plated steel sheet is heated for hot press forming, a thickness of the plating layer increases as the plating layer and the base iron are alloyed, and here, since the plating layer has a very low solubility of C, C which has not been dissolved during the alloying process is concentrated in the surface layer portion, and thus, the C content of the surface layer portion increases, and the high C content of the surface layer portion increases hardness of the surface layer portion to deteriorate bendability.

Meanwhile, in the case of manufacturing a hot press formed member by hot press forming the plated steel sheet for hot press forming according to an aspect of the present disclosure, even if C is concentrated in the member surface portion, the ratio ($C_{PS}/C_B$) of the C content ($C_{PS}$) of the member surface layer portion to the C content ($C_B$) of the base steel sheet is 1.2 or less, so that an excessive increase in hardness of the member surface layer portion may be inhibited. In addition, since the ratio (($Mn_{PS}$+$Cr_{PS}$)/($Mn_B$+$Cr_B$)) of the sum ($Mn_{PS}$+$Cr_{PS}$) of the contents of Mn and Cr of the member surface layer portion to the sum ($Mn_B$+$Cr_B$) of the contents of Mn and Cr of the base steel sheet is 0.8 or more, hardenability is sufficient and thus formation of ferrite formation may be inhibited, so that a coverage rate of ferrite at the martensitic grain boundary in the member surface layer portion (a rate occupied by ferrite in the martensitic grain boundary when a cross section is observed) may be 30% or less, and as a result, excellent bendability may be secured with sufficient strength.

As described above, as the hot press formed member according to an aspect of the present disclosure has the ratio ($C_s/C_B$) of 1.2 or less and satisfies the ratio (($Mn_{PS}$+$Cr_p$s)/($Mn_B$+$Cr_B$)) of 0.8 or more, a bending angle measured in a VDA238-100 bending test at a tensile strength of 1500 MPa level is 600 or more, so excellent impact resistant properties may be secured. However, if tensile strength increases, for example, when the tensile strength of the hot press formed member is 1800 MPa or higher, a criterion for the bending angle for determining excellent impact resistant properties may be lowered.

Next, a method of manufacturing a plated steel sheet for hot press forming and a hot press formed member having excellent impact resistant properties after hot press forming according to another aspect of the present disclosure will be described in detail.

Method for manufacturing a plated steel sheet for hot press forming having excellent impact resistant properties after hot press forming A method of manufacturing a plated steel sheet for hot press forming having excellent impact resistant properties after hot press forming according to another aspect of the present disclosure includes heating a slab satisfying the aforementioned alloy composition to 1050° C. to 1300° C.; finish-hot-rolling the heated slab in a temperature range of 800° C. to 950° C. to obtain a hot rolled steel sheet; coiling the hot rolled steel sheet at 450° C. to 750° C. after the finish hot rolling terminates; annealing the coiled hot rolled steel sheet by heating at 740° C. to 860° C. under the atmosphere in which a dew point temperature is −10° C. to 30° C. for 10 to 600 seconds; and immersing the annealed hot rolled steel sheet in a plating bath formed of zinc, aluminum, or alloys thereof to perform plating.

Slab Heating Step

First, the slab that satisfies the aforementioned alloy composition is heated to 1050° C. to 1300° C. (1050~1300° C.). If the slab heating temperature is less than 1050° C., it may be difficult to homogenize the slab structure, and if the temperature exceeds 1300° C., an excessive oxide layer may be formed.

Hot Rolling Step

The heated slab is finish hot-rolled in a temperature range of 800° C. to 950° C. (800~950) to obtain a hot-rolled steel sheet. If the finish hot rolling temperature is less than 800° C., it may be difficult to control a shape of a plate due to an occurrence of a duplex grain structure at the surface layer portion of the steel sheet due to rolling at two phase regions, and if the temperature exceeds 950° C., grains become coarse.

Cooling and Coiling Step

After the finish hot rolling terminates, the hot-rolled steel sheet is coiled at 450° C. to 750° C. If a coiling temperature is less than 450° C., material variations in a width direction increase, causing strip breakage and shape defects during cold rolling. Meanwhile, if the coiling temperature exceeds 750° C., carbides become coarse, leading to inferior bendability.

Cold Rolling Step

If necessary, a step of obtaining a cold-rolled steel sheet by cold rolling the coiled hot-rolled steel sheet may be further performed before annealing. The cold rolling is carried out for more precise control of the thickness of the steel sheet, and annealing and plating may be performed immediately without cold rolling. Here, the cold rolling may be performed at a reduction rate of 30% to 80%.

Annealing Step annealing is conducted for 10 to 600 seconds under an atmosphere in which a dew point temperature is −10 to 30° C. by heating the coiled hot-rolled steel sheet to 740° C.~860° C. If an annealing temperature is less than 740° C. or if an annealing time is less than 10 seconds, the structure may not be sufficiently recrystallized to form a poor sheet shape, or strength after plating is too high, which may cause die wear during a blanking process. In addition, diffusion of C during annealing is insufficient, making it difficult to secure the ratio ($C_s/C_B$) of the C content ($C_S$) of the surface layer portion to the C content ($C_B$) of the base steel sheet to 0.6 or less. Meanwhile, if the annealing temperature exceeds 860° C. or if the annealing time exceeds 600 seconds, a large amount of annealing oxide may be formed on the surface of the steel sheet during annealing, causing unplating or deteriorating plating adhesion. In addition, Mn, Cr, etc. in the base steel sheet are formed at an interface between the plating layer and the base steel sheet or at a base steel sheet grain boundary, making it difficult to obtain 0.8 or more as a ratio (($Mn_S$+$Cr_S$)/($Mn_B$+$Cr_B$)) of the sum ($Mn_S$+$Cr_S$) of contents of Mn and Cr of the surface layer portion to the sum ($Mn_B$+$Cr_B$) of contents of Mn and Cr of the base steel sheet, resulting in shortage of hardenability of the surface layer portion, and accordingly, ferrite may be partially formed in the surface layer portion after hot press forming to degrade bendability.

Meanwhile, in the present disclosure, it is very important to control a dew point temperature of the annealing atmosphere in order to control the ratio of the C, Mn, and Cr contents in the surface layer portion to the base material component of the base steel sheet. If the dew point temperature of the annealing atmosphere is less than −10° C., a decarburization reaction may become insufficient and the effect of improving bendability may be insignificant. Meanwhile, if the dew point temperature exceeds 30° C., hardenability of the surface layer portion may decrease due to excessive internal oxidation, resulting in partial ferrite formation to deteriorate bendability.

In addition, according to an aspect of the present disclosure, the annealing may be performed for 10 to 100 seconds under an atmosphere in which a dew point temperature is 10 to 30° C. by heating the coiled hot-rolled steel sheet to 800 to 840° C. (800~840° C.) more preferably.

Plating Step

After annealing, the coiled hot-rolled steel sheet is immersed to be plated in a plating bath formed of zinc, aluminum, or alloys thereof. In the present disclosure, the components of the plating bath used when forming the plating layer may not be particularly limited. However, as a non-limiting example, the plating bath used in the present disclosure may be formed of zinc, a zinc alloy, aluminum, or an aluminum alloy. In addition, plating conditions may be applied without limitation to the present disclosure as long as the plating conditions are commonly applied to a hot press forming steel sheet, and thus are not specifically mentioned in the present disclosure. In addition, according to an aspect of the present disclosure, the plating bath may include other inevitable impurities, and the zinc alloy and aluminum alloy may also include components that may be commonly included within a range not impairing the object of the present disclosure, and in particular, may include other inevitable impurities.

Method for Manufacturing a Hot Press Formed Member Having Excellent Impact Properties A hot press formed member having excellent impact resistant properties may be manufactured by hot press forming the plated steel sheet for hot press forming manufactured by the manufacturing method of the present disclosure described above. Here, the hot press forming may be performed using a method generally used in the art. However, as a non-limiting example, the plated steel sheet for hot press forming may be heat-treated in a temperature range of Ac3 to 950° C. for 1 to 15 minutes and then pressed to perform hot press forming.

MODE FOR INVENTION

Hereinafter, the present disclosure will be described in more detail through examples. However, it should be noted that the following examples are for illustrative purposes only and are not intended to limit the scope of the present disclosure. This is because the scope of the present disclosure is determined by matters described in the claims and matters reasonably inferred therefrom.

Example

First, a slab having an alloy composition shown in Table 1 was prepared, heated, hot rolled, and coiled under the manufacturing conditions illustrated in Table 2 below to manufacture a hot rolled steel sheet. Thereafter, the manufactured steel sheet was annealed under the annealing conditions illustrated in FIG. 2 and subsequently immersed in a zinc plating bath, and then, plating was performed so that a coating amount per side was 70 g/m$^2$ to manufacture a plated steel sheet.

TABLE 1

| Classification | C | Si | Mn | P | S | Al | N | Cr | Ti | B |
|---|---|---|---|---|---|---|---|---|---|---|
| Steel A | 0.21 | 0.25 | 1.3 | 0.01 | 0.002 | 0.035 | 0.005 | 0.22 | 0.03 | 0.0022 |
| Steel B | 0.2 | 0.1 | 2.5 | 0.009 | 0.001 | 0.03 | 0.004 | 0.1 | — | — |

TABLE 2

| Classification | Steel grade | Slab heating temperature (° C.) | Finish hot rolling temperature (° C.) | Coiling temperature (° C.) | Annealing condition: Heating temperature (° C.) | Annealing condition: Holding time (Sec.) | Annealing condition: Dew point temperature (° C.) |
|---|---|---|---|---|---|---|---|
| IE 1 | A | 1250 | 900 | 560 | 820 | 42 | 15 |
| IE 2 | B | 1200 | 880 | 500 | 800 | 65 | 10 |
| CE 1 | A | 1250 | 900 | 560 | 820 | 42 | −15 |
| CE 2 | A | 1250 | 900 | 560 | 700 | 45 | 10 |
| CE 3 | B | 1200 | 880 | 500 | 800 | 65 | 40 |
| CE 4 | B | 1200 | 880 | 500 | 870 | 620 | 15 |

IE: Inventive Example
CE: Comparative Example

For the plated steel sheets of Inventive Examples and Comparative Examples manufactured according to the above manufacturing conditions, concentrations of carbon (C), manganese (Mn), and chromium (Cr) were analyzed to a sufficient depth from a surface layer in a depth direction using a Glow Discharge Spectrometer (GDS) (GDS 850A by USA LECO) capable of quantitatively analyzing various components. An average content of a region corresponding to a surface layer portion was analyzed from results of GDS analysis using integration and results thereof are shown in Table 3 below. In general, in the case of GDS analysis, depth directional analysis is performed on a circular area of 2 mm to 6 mm, and thus, it may be difficult to specify an exact plating layer/base steel sheet interface in terms of a concentration profile for the depth direction, but, in the present disclosure, a point at which a Zn content was 1% was set as the plating layer/base steel sheet interface based on various optical and SEM analysis results, etc.

TABLE 3

| Classification | Steel grade | $C_B$ | $C_S$ | Ratio ($C_S/C_B$) | $Mn_B + Cr_B$ | $Mn_S + Cr_S$ | Ratio (($Mn_S + Cr_S$)/($Mn_B + Cr_B$)) |
|---|---|---|---|---|---|---|---|
| IE 1 | A | 0.21 | 0.03 | 0.14 | 1.52 | 1.32 | 0.87 |
| IE 2 | B | 0.2 | 0.07 | 0.35 | 2.6 | 2.43 | 0.93 |
| CE 1 | A | 0.21 | 0.2 | 0.95 | 1.52 | 1.49 | 0.98 |
| CE 2 | A | 0.21 | 0.19 | 0.90 | 1.52 | 1.5 | 0.99 |
| CE 3 | B | 0.2 | 0.02 | 0.10 | 2.6 | 1.74 | 0.67 |
| CE 4 | B | 0.2 | 0.01 | 0.05 | 2.6 | 1.52 | 0.58 |

IE: Inventive Example
CE: Comparative Example

In addition, a hot press formed member was manufactured by performing hot press forming on the plated steel sheets of Inventive Examples and Comparative Examples under the conditions described in Table 4 below. Tensile test and bending test (VDA238-100) were performed by taking a specimen from a plane portion of the manufactured hot press formed member. Concentration analysis of C, Mn, and Cr was performed through GDS analysis in the depth direction and a coverage rate of ferrite at a martensitic grain boundary of a member surface layer portion was evaluated through observation of a cross-section with an optical microscope. Results thereof are shown together in Table 4.

TABLE 4

| Classification | Hot press forming condition: Heating temperature (° C.) | Hot press forming condition: Heating time (min.) | Ratio ($C_{PS}/C_B$) | Coverage: Ratio ($Mn_{PS} + Cr_{PS}$)/($Mn_B + Cr_B$)) | Coverage: rate of ferrite (%) | Tensile strength (MPa) | Bending angle (degree) |
|---|---|---|---|---|---|---|---|
| IE 1 | 900 | 6 | 0.95 | 0.93 | 0.5 | 1502 | 72 |
| IE 2 | 930 | 5 | 1.05 | 0.97 | 2.7 | 1527 | 67 |
| CE 1 | 930 | 5 | 1.52 | 0.98 | 0.2 | 1508 | 53 |
| CE 2 | 900 | 6 | 1.29 | 0.99 | 1.3 | 1511 | 51 |
| CE 3 | 900 | 6 | 0.9 | 0.76 | 36 | 1478 | 42 |
| CE 4 | 930 | 5 | 0.88 | 0.65 | 48 | 1427 | 47 |

IE: Inventive Example
CE: Comparative Example

The plated steel sheets of Invention Examples 1 and 2 manufactured according to the conditions of the present disclosure satisfied a ratio ($C_s/C_B$) of 0.6 or less and a ratio (($Mn_S$+$Cr_S$)/($Mn_B$+$Cr_B$)) of 0.8 or more. Accordingly, the hot press formed member manufactured by hot press forming the plated steel sheets of Inventive Examples 1 and 2 satisfied a ratio ($C_{PS}/C_B$) of 1.2 or less, and a ratio (($Mn_{PS}$+$Cr_{PS}$)/($Mn_B$+$Cr_B$)) of 0.8 or more, and accordingly, a coverage rate of ferrite at the martensitic grain boundary of the surface layer portion was 30% or less, and a bending angle was 60 or more at a tensile strength of 1500 MPa grade, indicating good bending characteristics.

Comparative Example 1 is a case in which a dew point temperature was less than −10° C. during annealing, and Comparative Example 2 is a case in which a heating temperature was not reached during annealing. Both Comparative Examples 1 and 2 had a ratio ($C_s/C_B$) of the plated steel sheet exceeding 0.6, and accordingly, the ratio ($C_{PS}/C_B$) in the hot press formed member also exceeded 1.2, resulting in poor bending properties.

Meanwhile, Comparative Example 3 is a case in which a dew point temperature during annealing exceeded 30° C., and Comparative Example 4 is a case in which annealing was excessively performed. In both Comparative Examples 3 and 4, a ratio ($C_s/C_B$) of the plated steel sheets satisfied the conditions of the present disclosure, but the ratio (($Mn_S$+$Cr_S$)/($Mn_B$+$Cr_B$)) was less than 0.8 and the ratio (($Mn_{PS}$+$Cr_{PS}$)/($Mn_B$+$Cr_B$)) of the hot press formed member was less than 0.8. As a result, a coverage rate of ferrite at the martensitic grain boundary of the member surface layer portion exceeded 30%, and tensile strength was relatively low and bendability was also very deteriorated, compared to the other examples.

While embodiments of the present disclosure have been shown and described, it will be apparent to those skilled in the art that modifications and variations could be made without departing from the scope of the present invention. Therefore, the scope of the present invention is not limited to the embodiments but should be defined by the appended claims and equivalents thereof.

The invention claimed is:

1. A plated steel sheet for hot press forming, the plated steel sheet comprising:

a base steel sheet including, by wt %, 0.15% to 0.4% of carbon (C), 0.1% to 1% of silicon (Si), 0.6% to 8% of manganese (Mn), 0.001% to 0.05% of phosphorus (P), 0.0001% to 0.02% of sulfur(S), 0.01% to 0.1% of aluminum (Al), 0.001% to 0.02% of nitrogen (N), 0.01% to 0.5% of chromium (Cr), a balance of Fe, and other impurities; and a plating layer including zinc, aluminum, or alloys thereof on a surface of the base steel sheet, wherein a ratio (Cs/CB) of a C content (Cs) of a surface layer portion to a C content (CB) of the base steel sheet is 0.6 or less, and a ratio ((Mns+Crs)/(MnB+CrB)) of a sum (Mns+Crs) of contents of Mn and Cr of the surface layer portion to a sum (MnB+CrB) of contents of Mn and Cr of the base steel sheet is 0.8 or more, wherein the surface layer portion refers to a region to a depth of 15 μm from the surface of the base steel sheet excluding the plating layer.

2. The plated steel sheet of claim 1, wherein the base steel sheet further includes, by wt %, one or more of 0.0005% to 0.01% of boron (B) and 0.01% to 0.05% of titanium (Ti).

3. The plated steel sheet of claim 1, wherein a microstructure of the surface layer portion in the base steel sheet includes, by area fraction, 40% to 100% of ferrite and a balance of 0% to 60% of pearlite, bainite, or martensite, and a microstructure of a central portion in the base steel includes, by area fraction, 30% to 90% of ferrite and a balance of 10% to 70% of pearlite, bainite, or martensite.

* * * * *